US006608127B1

(12) United States Patent
Kato et al.

(10) Patent No.: US 6,608,127 B1
(45) **Date of Patent: *Aug. 19, 2003**

(54) GOLF BALL

(75) Inventors: Akira Kato, Kobe (JP); Hidenori Hiraoka, Akashi (JP); Masatoshi Yokota, Akashi (JP); Satoshi Iwami, Akashi (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 291 days.

This patent is subject to a terminal disclaimer.

(21) Appl. No.: 09/612,521

(22) Filed: Jul. 6, 2000

(30) Foreign Application Priority Data

Jul. 7, 1999 (JP) ..... 11-193365

(51) Int. Cl.[7] ..... A63B 37/12; C08L 33/02

(52) U.S. Cl. ..... 524/272; 525/92 A; 525/93; 525/143; 525/149; 525/221; 473/378; 473/385

(58) Field of Search ..... 525/92 A, 93, 525/143, 221, 149; 524/272; 473/378, 385

(56) References Cited

U.S. PATENT DOCUMENTS 4,409,366 A * 10/1983 Schmelzer
4,943,332 A * 7/1990 Sakaguch
4,963,361 A * 10/1990 Kawazi
5,150,905 A * 9/1992 Yuki
6,371,869 B1 * 4/2002 Kato

FOREIGN PATENT DOCUMENTS

| | | |
|---|---|---|
| GB | A2311530 | 1/1997 |
| JP | A10179801 | 7/1998 |
| JP | A10179802 | 7/1998 |

OTHER PUBLICATIONS

Cochran, *Science and Golf II* p. 334–339, 1994.*

* cited by examiner

*Primary Examiner*—David J. Buttner
(74) *Attorney, Agent, or Firm*—Birch, Stewart, Kolasch & Birch, LLP

(57) ABSTRACT

A golf ball exhibits a high spin and easily comes to a halt even when shot from the rough or when shot in a raining condition. The cover material of the golf ball is based on ionomer resin. The cover material has 5–50 parts by weight of a tackifier such as terpene resins, rosin ester resins or the like blended with respect to 100 parts by weight of the base material.

5 Claims, No Drawings

GOLF BALL

BACKGROUND OF THE INVENTION

1. Field of the Invention

The present invention relates to golf balls, particularly a golf ball that exhibits high spinning and that easily comes to a halt even when shot from the rough or when shot in a raining condition such as a balata covered golf ball.

2. Description of the Background Art

Golf balls with a balata cover are generally widely used by low handicap and professional golfers by virtue of its superior hit feeling and controllability. Recently, various soft covers have been proposed to replace balata covers due to their complicated fabrication process and poor cut resistance.

For example, the basic resin of a cover disclosed in Japanese Patent Laying-Open No. 10-179802 is formed having as the main component a heated mixture of ionomer resin, and a styrene-butadiene-styrene block copolymer including a polybutadiene block containing an epoxy group or a styrene-isoprene-styrene block copolymer including a polyisoprene block containing an epoxy group. A golf ball is proposed characterized in that the cover composition forming the cover has a flexural modulus of 50–300 MPa and a Shore D hardness of 40–60.

The basic resin of a cover disclosed in Japanese Patent Laying-Open No. 10-179801 is formed having as the main component a heated mixture of ionomer resin, acid modified thermoplastic elastomer or thermoplastic elastomer with an OH group added at the terminal, and a styrene-butadiene-styrene block copolymer including a polybutadiene block containing epoxy or a styrene-isoprene-styrene block copolymer including a polyisoprene block containing epoxy. A golf ball is proposed characterized in that the cover composition forming the cover has a flexural modulus of 50–300 MPa and a Shore D hardness of 40–60.

Although the golf balls of these inventions are improved in the hit feeling (feeling imparted to the golfer when the ball is hit), controllability, and cut resistance, the spin rate in a wet condition is inferior to the spin rate in a dry condition. These golf balls were not satisfactory from the aspect of spin maintenance.

SUMMARY OF THE INVENTION

An object of the present invention is to provide a golf ball having a high ratio of the spin rate in a wet condition to the spin rate in a dry condition, i.e., having a high spin maintenance.

According to an aspect of the present invention, a golf ball formed of a core and a cover is characterized in that the cover composition is blended with basic resin and a tackifier.

Particularly, the basic resin of the cover is preferably ionomer resin alone, or ionomer resin blended with one or at least two types of polystyrene type elastomer, polyolefin type elastomer, polyurethane type elastomer and polyester type elastomer. A tackifier such as terpene resins and rosin ester resin is added 5–50 parts by weight to the basic resin.

The foregoing and other objects, features, aspects and advantages of the present invention will become more apparent from the following detailed description of the present invention.

DESCRIPTION OF THE PREFERRED EMBODIMENTS

In the present invention, the ionomer resin employed as the basic resin of the cover is, for example, a copolymer of α-olefin and α, β-unsaturated carboxylic acid of carbon number 3–8, obtained by neutralizing at least a portion of the carboxyl group thereof with metallic ion. Alternatively, a ternary copolymer of α-olefin, α, β-unsaturated carboxylic acid of carbon number 3–8, and α, β-unsaturated carboxylic acid ester of carbon number 2–22, obtained by neutralizing at least a portion of the carboxyl group thereof can be used. As to the composition ratio, 80–90% by weight of α-olefin and 10–20% by weight of α, β-unsaturated carboxylic acid are preferable when the base polymer of the ionomer resin is a copolymer of α-olefin and α, β-unsaturated carboxylic acid of carbon number 3–8. When the base polymer is a ternary copolymer of α-olefin, α, β-unsaturated carboxylic acid of carbon number 3–8, and α, β-unsaturated carboxylic acid ester of carbon number 2–22, 70–85% by weight of α-olefin, 5–20% by weight of α, β-unsaturated carboxylic acid, and 10–25% by weight of α, β-unsaturated carboxylic acid are preferable. It is also preferable that the melt index (MI) of these ionomer resins is 0.1–20, preferably 0.2–20, particularly 0.5–15.

As the α-olefin, ethylene, propylene, 1-butene, 1-pentene, for example, are employed, wherein ethylene is particularly preferable. As the α, β-unsaturated carboxylic acid of carbon number 3–8, acrylic acid, methacrylic acid, fumaric acid, maleic acid, crotonic acid, for example, are employed, wherein acrylic acid and methacrylic acid are particularly preferable. As the unsaturated carboxylic acid ester, methyl, ethyl, propyl, n-butyl, isobutyl ester or the like of acrylic acid, methacrylic acid, fumaric acid, maleic acid or the like, for example, are employed, wherein acrylic acid ester and methacrylic acid ester are particularly preferable. As the metallic ion neutralizing at least a portion of the carboxyl group in the copolymer of α-olefin and α, β-unsaturated carboxylic acid or the ternary copolymer of α-olefin, α, β-unsaturated carboxylic acid and α, β-unsaturated carboxylic acid ester, sodium ion, lithium ion, zinc ion, magnesium ion, potassium ion, or the like, for example, can be enumerated. When the ionomer resin has at least a portion of the carboxyl group in the copolymer of ethylene and acrylic acid or methacrylic acid neutralized with metallic ions, the highly rigid and high flow type having a melt index of 3–7 and a flexural modulus of 200–400 MPa is preferable.

Specific trade names of the ionomer resin are enumerated in the following. Hi-milan 1605 (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), and Hi-milan MK7320 (K) sold by Mitsui-Du Pont Polychemical Co., Ltd. are available. As the ternary copolymer ionomer resin, Hi-milan 1856 (Na), Hi-milan 1855 (Zn), Hi-milan AM7316 (Zn), and the like are available from Mitsui-Du Pont Polychemical Co., Ltd. From Du Pont Co. are available Surlyn 8920 (Na), Surlyn 8940 (Na), Surlyn 8945 (Na), Surlyn 9910 (Zn), Surlyn 9945 (Zn), Surlyn 7930 (Li) and Surlyn 7940 (Li) as the ionomer resin, and Surlyn AD8265 (Na), Surlyn AD8269 (Na) and the like as the ternary copolymer type ionomer resin.

As the ionomer resin available from Exxon Chemical Japan Ltd., Iotek 7010 (Zn), Iotek 8000 (Na) and the like can be enumerated. Na, Zn, K, Li, Mg and the like in the above parenthesis following respective trade names of the ionomer resin indicate the metal type of these neutralize metallic ions. In the present invention, the ionomer resin used for the basic resin of the cover may have at least two of those enumerated above mixed. Alternatively, at least two types of the ionomer resin neutralized with monovalent metallic ions enumerated above and ionomer resin neutralized with divalent metallic ions can be mixed to be used.

As the tackifier employed in the present invention, coumarone-indene type resins, polyterpene type resins, rosin derivatives, phenol-formaldehyde type resins, alkyl phenol-formaldehyde type resins, petroleum type resins, xylene-formaldehyde type resins, oligomers of polybutene, liquid rubber such as liquid polyisoprene and the like can be enumerated. Particularly, the terpene type resins and rosin ester type resins are preferably applicable.

Furthermore, hydrogenated terpene resins are favorable. Particularly, hydrogenated terpene resins having a softening point that is not higher than 130° C., measured according to JIS-K 6863, are preferable.

Specific trade names of the tackifier are set forth in the following. As the coumarone resins, Process Resin A81, Process Resin AC5, Process Resin TX from Kobe Petrochemical Industry Co., Ltd., Coumarone CL from Ouchishinko Chemical Industrial Co., Ltd., and Coumarone resin NG4 from Nippon Steel Chemical Industries, Co., Ltd. are available. As terpene-phenol resin, Tackirol 101, Tackirol 106, Tackirol EP20, Tackirol EP30 from Sumitomo Chemical Co., Ltd. and Sumilight Resin PR19900 from Sumitomo Dulez Co., Ltd. are available.

As the petroleum type resins, hydrogenated terpene resins from Yasuhara Chemical Co., Ltd., Arkon P90 and Ester Gum H from Arakawa Chemical Co., Ltd., and Petro resin #80, Hilets G100X from Mitsui Petro Chemical Industries, Ltd. are available.

As the rosin derivatives, Nikanol A70 from Mitsubishi Gas Chemical Co., Inc., Lignol R70 from Libnite, and Rosin ester resin from Arakawa Chemical Industries, Co., Ltd. are available.

It is to be noted that a tackifier having a softening point not higher than 130° C., measured according to the testing methods for the softening point of hot melt adhesives of JIS-K 6863, is to be used. By using a tackifier having a softening point not higher than 130° C., the effect of improving the spin maintenance becomes higher. If the softening point is too low, workability is degraded. Therefore, the preferable range of the softening point for the tackifier is 50° C.–130° C., further preferably 70° C.–110° C.

These tackifiers are dispersed-mixed into the basic resin of the cover to provide appropriate adherence to the cover. As a result, the adherence onto the club face is improved when hitting the golf ball. To this end, 5–50 parts by weight, preferably 10–40 parts by weight, further preferably 20–30 parts by weight of the tackifier are blended with respect to 100 parts by weight of the basic resin of the cover. If the blend is less than 5 parts by weight, sufficient adherence cannot be provided to the cover. If the blend exceeds 50 parts by weight, there is a tendency of degradation in the cover's basic characteristics of hardness, feeling and durability.

As to the basic resin for the cover of the present invention, at least one type of polystyrene type elastomer, polyolefin type elastomer, polyurethane type elastomer and polyester type elastomer can be mixed with ionomer resin for usage.

As specific examples of the polystyrene type elastomer in trade name, ESBS A1010 of Daicel Chemical Industries Ltd., and Septon HG-252 of Kuraray Co., Ltd. can be enumerated.

As specific examples of the polyolefin type elastomer in trade name, Milastomer M4800NW of Mitsui Chemical Industries, Ltd. and Sumitomo TPE 3682, 9455 from Sumitomo Chemical Co., Ltd. can be enumerated.

As specific examples of the polyurethane type elastomer in trade name, Kuramilon 9195, 9180 from Kuraray Co., Ltd. and Elastollan ET880 from Takeda Badische Urethane Industries, Ltd. can be enumerated.

As specific examples of the polyester type elastomer in trade name, Hytrel of Toray-DuPont Co., Ltd. can be enumerated.

The cover composition to form a cover in the present invention can have various additives such as a pigment, dispersion, antioxidant, ultraviolet absorbent, photostabilizer and the like added, if necessary.

The foregoing cover composition can be used to cover either a solid core or a thread-wound core.

The solid core can be of the type of one layer structure or a multilayer structure of two or more layers. For example, the solid core of a two piece ball is produced by heating and compressing a rubber composition for 10–40 minutes at the temperature of 140–170° C., for example, by press-curing to form into a spherical cured product. The rubber composition is blended with 10–50 parts by weight in total of one or at least two types of a cross-linker formed of $\alpha$, $\beta$-monoethylenic unsaturated carboxylic acid such as acrylic acid or methacrylic acid or metal salt thereof, or a trimethylol propane trimethacrylate polyfunctional monomer, 10–30 parts by weight of a filler such as of zinc oxide or barium sulfate, 0.5–5 parts by weight of a peroxide such as dicumyl peroxide, and, if necessary, 0.1–1 parts by weight of an antioxidant with respect to 100 parts by weight of polybutadiene.

The thread-wound core is constituted by a center and a rubber thread layer formed by winding rubber thread in an elongated state around the center. The center may be a solid center composed of a vulcanizate of a rubber composition, or a liquid center having water or liquid such as paste sealed in the center cover of vulcanized rubber. For the solid center, the diameter is preferably 28–38 mm and the deformation from the initial state of applying an initial load of 10 kg to the center to the state of applying a final load of 30 kg is preferably 0.5–6.0 mm, further preferably 0.5–5.0 mm, and particularly preferably 0.5–2.5 mm. If the diameter of the solid center is smaller than 28 mm, the shot angle will become so small that the spin rate is increased. As a result, the flight distance cannot be increased. If the diameter of the solid center is greater than 38 mm, the winding process of the rubber thread will end before tension is applied on the rubber thread. Therefore, repulsion of the rubber thread layer cannot be exhibited sufficiently, so that the impact resilience of the ball is degraded. As a result, the flight distance cannot be increased. If the deformation of the solid center is a smaller than 0.5 mm, the center will be too hard for the ball. The hit feeling when the ball is shot will be degraded. If the deformation of the solid center is greater than 6.0 mm, the center will become too soft. The appropriate hardness for the ball cannot be obtained. There is also the possibility that the ball's initial speed is decreased. For a liquid center, the diameter is preferably 26–34 mm. If the diameter of the liquid center is smaller than 26 mm, the shot angle will be reduced and the spin rate increased. As a result, the flight distance cannot be increased. If the diameter of the liquid center is greater than 34 mm, the predetermined ball hardness cannot be obtained. Also, the impact resilience of the ball will be degraded since the rubber thread layer becomes thinner. As a result, the flight distance cannot be increased.

The foregoing rubber thread can be obtained by vulcanizing a rubber composition having an antioxidant, vulcanization accelerator, sulfur and the like blended with natural rubber or blended rubber of natural rubber and synthesized polyisoprene.

The cover of the golf ball of the present invention has a Shore D hardness within the range of 40–65 after molding. If the Shore D hardness of the cover composition is lower than 40, the cover will become so soft that the cut resistance is degraded. If the Shore D hardness is greater than 65, an appropriate back spin rate cannot be obtained. As a result, the controllability and hit feeling are degraded.

EXAMPLE

The present invention will be described specifically with reference to examples.

Examples 1–5 of the present invention and comparative examples 1–3

Golf balls of the examples of the present invention and of comparative examples were produced through the following steps of (1)–(3).

(1) Production of Solid Core

Rubber compositions shown in the following Table 1 were prepared. By filling a mold with the prepared rubber composition and applying vulcanization, a spherical solid core of 36.0 mm in diameter was obtained. Vulcanization was effected for 20 minutes at 165° C., as indicated by the vulcanization condition in Table 1. The deformation when a load of 10–30 kg was applied on the obtained solid core (deformation from the state of applying the initial load of 10 kg to the state of applying the final load of 30 kg on the solid core) was 0.9 mm. The blended values of various components in Table 1 correspond to parts by weight. Rubber thread whose base rubber has the ratio of natural rubber/low cis polyisoprene of 50/50 (weight ratio) was wound around the solid core to produce a thread-wound core of 39.00 mm in outer diameter.

TABLE 1

| | | |
|---|---|---|
| Solid Center Component | BR11 ·X·1 | 100 |
| | Zinc Acrylate | 28 |
| | Zinc Oxide | 15 |
| | Barium Sulfate | 20 |
| | Antioxidant ·X·2 | 0.5 |
| | Dicumyl Peroxide | 1.0 |
| Solid Center Physical Property | Weight (g) | 30.0 |
| | Diameter(mm) | 36.0 |
| | Deformation(mm) (10 kg → 30 kg) | 0.9 |

Vulcanization Condition: 165° C. × 20 minutes
·X·1: High cis-polybutadiene from Japan Synthetic Rubber Co., Ltd. (Containing 96% of cis content)
·X·2: Trade name NoclacNS-6, Ouchi Shinko Chemical Industries, Co., Ltd. 2,5-di-tertiary, butyl hydroquinone (2) Preparation of Cover Composition The blended material of the compositions shown in the following Table 2 were mixed by a two-shaft kneading type extruder to prepare cover compositions A–H in the form of pellets. The blended values in Table 2 correspond to parts by weight. Details of those indicated by trade names in Table 2 are provided below Table 2.

Extrusion was carried out under the condition of the screw diameter of 45 mm, the screw rotating speed of 200 rpm, and the screw L/D=35.

The blended compound was heated to 220–260° C. at the position of the die in the extruder.

TABLE 2

| | Example | | | | | Comparative Example | | |
|---|---|---|---|---|---|---|---|---|
| | A | B | C | D | E | F | G | H |
| Hi-milan 1605 ·X·3 | 50 | | | | | 50 | | |
| Hi-milan 1706 ·X·4 | 50 | | | | | 50 | | |
| Surlyn 9945 ·X·5 | | 25 | 25 | 25 | 25 | | 25 | 20 |
| Surlyn 8945 ·X·6 | | 25 | 25 | 25 | 25 | | 25 | 20 |
| Epofriend A1010 ·X·7 | | 15 | 15 | 15 | 15 | | 15 | 20 |
| Septon HG-252 ·X·8 | | 35 | 35 | 35 | 35 | | 35 | 40 |
| Clearon P105 ·X·9 | 20 | 10 | 20 | 30 | | | | |
| EsterGum H ·X·10 | | | | | 20 | | | |
| Titanium Dioxide | 2 | 2 | 2 | 2 | 2 | 2 | 2 | 2 |
| Barium Sulfate | 2 | 2 | 2 | 2 | 2 | 2 | 2 | 2 |
| Cover Hardness (Shore D Hardness) ·X·11 | 65 | 51 | 49 | 47 | 48 | 70 | 53 | 49 |

·X·3: Hi-milan 1605 (trade name) Mitsui-Du Pont Polychemical Co., Ltd Sodium ion neutral ethylene-methacrylic acid copolymer type ionomer resin MI = 2.8, flexural modulus = approximately 310 Mpa
·X·4: Hi-milan 1706 (trade name) Mitsui-Du Pont Polychemical Co., Ltd Zinc ion neutral ethylene-methacrylic acid copolymer type ionomer resin MI = 0.8, flexural modulus = approximately 260 Mpa
·X·5: Surlyn 9945 (trade name) Du Pont Co., Ltd Zinc ion neutral ethylene-methacrylic acid copolymer type ionomer resin MI = 3.4, flexural modulus = approximately 220 Mpa
·X·6: Surlyn 8945 (trade name) Du Pont Co., Ltd Sodium ion neutral ethylene-methacrylic acid copolymer type ionomer resin MI = 4.4, flexural modulus = approximately 280 Mpa
·X·7: Epofriend A1010 (trade name) Daicel Chemical Industries Ltd Block copolymer of SBS structure including polybutadiene block containing epoxy group, JIS-A hardness = 67, styrene/butadien = 40/60 (weight ratio) containing approximately 1.5–1.7% by weight of epoxy group
·X·8: Septon HG-252 (trade name) Kuraray Co., Ltd Hydrogenated styrene-isoprene-styrene block copolymer with —OH group added to terminal, JIS-A hardness = 80, containing approximately 40% by weight of styrene
·X·9: Clearon P105 (trade name) Yasuhara Chemical Co., Ltd. (Softening point is 105° C. measured according to JIS-K6863) Hydrogenated terpene resin
·X·10: Ester Gum H (trade name) Arakawa Chemical Co., Ltd. Hydrogenated rosin ester resin
·X·11: Indicating cover haraness of molded ball (3) Production of Golf Ball having Multilayer Structure with Rubber Thread Layer A hemispherical half shell was formed from the cover composition of the above (2). The thread-wound core of the above (1) was enveloped by two of the half shells, and subjected to press-molding for two minutes at 150° C. in a ball mold. The thread-wound core with a cover had the surface painted to produce golf balls of examples 1–5 of the present invention and comparative examples 1–3 having an outer diameter of 42.8 mm. The combination of the center and cover used in producing these golf balls are shown in the following Table 3 together with the ball physical properties.

TABLE 3

| | Examples | | | | | Comparative Examples | | |
|---|---|---|---|---|---|---|---|---|
| | 1 | 2 | 3 | 4 | 5 | 1 | 2 | 3 |
| Cover blend No. | A | B | C | D | E | F | G | H |
| Spin rate in dry condition (rpm) | 5640 | 7200 | 7050 | 6980 | 7075 | 5300 | 7100 | 7350 |
| Spin rate in wet condition (rpm) | 2830 | 4220 | 4480 | 4870 | 4490 | 1650 | 2840 | 3020 |
| Spin Maintenance (%) | 50.2 | 58.6 | 63.5 | 69.8 | 63.5 | 31.1 | 40 | 41.1 |

The performance of the golf balls of the examples of the present invention and the comparative examples were carried out by the following methods.

(1) Measurement of Spin Rate

A sand wedge club was attached to a swing robot of True temper. Measurement was carried out with the ball shot at the head speed of 20 m/s. Measurement was carried out in the normal dry condition and in a wet condition where the ball and the club face were wetted with water.

The spin maintenance is defined as the value of spin rate when wet/spin rate when dry×100.

(2) Shore D Hardness

Values measured conforming to ASTMD-2240 under the state where the cover material is formed into a gold ball are shown.

It is appreciated from Table 3 that the golf balls of examples 1–5 are superior in spin maintenance to any of the golf balls of comparative examples 1–3.

By virtue of blending a tackifier in the cover material of the golf ball of the present invention, a high ratio of the spin rate in a wet condition to the spin rate in a dry condition, i.e. high spin maintenance, can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball comprising a core and a cover, wherein said cover comprises basic resin and a tackifier, and said cover has a hardness of 40–65 in Shore D hardness, wherein said tackifier comprises terpene resin and/or rosin ester resin.

2. The golf ball according to claim 1, wherein a blended amount of said tackifier is 5–50 parts by weight with respect to 100 parts by weight of said basic resin.

3. The golf ball according to claim 1, wherein the said basic resin includes an ionomer resin alone, or includes at least one of a member selected from the group consisting of polystyrene elastomer, polyolefin elastomer, polyurethane elastomer, and polyester elastomer, said member being blended with the ionomer resin as a main component.

4. The golf ball according to claim 1, wherein said tackifier is hydrogenated terpene resins having a softening point that is not higher than 130° C.

5. A golf ball comprising a core and a cover, wherein said cover comprises basic resin and a tackifier blended for said cover, wherein (a) a blended amount of said tackifier is 10–40 part by weight;

(b) said basic resin is a,blend of ionomer resin and one or at least two types of polystyrene elastomer, polyolefin elastomer, polyurethane elastomer, and polyester elastomer, and (c) said cover has a hardness within a rage of 40–65.

* * * * *